US011191317B2

(12) United States Patent
Soibelman

(10) Patent No.: US 11,191,317 B2
(45) Date of Patent: Dec. 7, 2021

(54) SWEAT GUARD LINER

(71) Applicant: Keith Soibelman, Cameron Park, CA (US)

(72) Inventor: Keith Soibelman, Cameron Park, CA (US)

( * ) Notice: Subject to any disclaimer, the term of this patent is extended or adjusted under 35 U.S.C. 154(b) by 133 days.

(21) Appl. No.: 16/833,511

(22) Filed: Mar. 28, 2020

(65) Prior Publication Data

US 2021/0112908 A1 Apr. 22, 2021

Related U.S. Application Data

(60) Provisional application No. 62/916,734, filed on Oct. 17, 2019.

(51) Int. Cl.
*A42C 5/02* (2006.01)

(52) U.S. Cl.
CPC ..... *A42C 5/02* (2013.01)

(58) Field of Classification Search
CPC .. A42C 5/02; A42C 5/00; A42B 1/011; A42B 1/012; A42B 1/0189; A42B 1/019; A42B 3/0406; A42B 3/04; A41D 27/12; A41D 27/13; A41D 27/133; A41D 27/136; A41D 27/16; A41D 27/26; A41D 2300/20; A41D 2300/24; A41B 3/18; A41B 7/12
USPC ..... 2/181–181.2, 182.8–184, 60, 61, 62, 63, 2/53–58
See application file for complete search history.

(56) References Cited

U.S. PATENT DOCUMENTS 2,390,565 A * 12/1945 Topjian ..... A41D 27/13 2/53
5,025,504 A * 6/1991 Benston ..... A42B 3/10 2/181.4
5,566,395 A * 10/1996 Nebeker ..... A42C 5/02 2/181
8,112,821 B1 * 2/2012 Barry ..... A42C 5/02 2/181
8,904,567 B2 * 12/2014 Johnson ..... A42B 3/10 2/181.4
2006/0150294 A1 * 7/2006 Yanamadala ..... A41D 27/13 2/53
2006/0288463 A1 * 12/2006 Bernard ..... A41D 27/12 2/46
2011/0072555 A1 * 3/2011 Asiatico ..... A42C 5/02 2/181.4

(Continued)

FOREIGN PATENT DOCUMENTS

GB 961972 A * 6/1964 ..... A41D 27/13

*Primary Examiner* — Amy Vanatta

(57) ABSTRACT

A headwear insert system is provided comprising a headwear insert having a planar multilayered substrate with a first side and a second side. The planar multilayered substrate may comprise a substantially oblong shape with a rounded plateau protruding from a top portion of the planar multilayered substrate. The planar multilayered substrate may further comprise a polyester mesh layer, a stabilizing layer, an absorptive layer and a neoprene layer. The stabilizing layer and the absorptive layer may be disposed between the polyester mesh layer and the neoprene layer. A seam may couple the polyester mesh layer and the neoprene layer together. The stabilizing layer and the absorptive layer may not be coupled to the seam, the polyester mesh layer nor the neoprene layer.

20 Claims, 2 Drawing Sheets

(56) References Cited

U.S. PATENT DOCUMENTS

| | | | | |
|---|---|---|---|---|
| 2013/0185843 | A1* | 7/2013 | Rahm | A42C 5/00 2/181 |
| 2013/0247281 | A1* | 9/2013 | Zebouni | A42C 5/02 2/272 |
| 2015/0059055 | A1* | 3/2015 | Johnson | A42B 3/10 2/181.4 |
| 2016/0255897 | A1* | 9/2016 | Johnson | A42B 3/127 |
| 2018/0160747 | A1* | 6/2018 | Epperson | A63B 71/12 |

* cited by examiner

100

200

SWEAT GUARD LINER

CROSS-REFERENCE TO RELATED APPLICATIONS

This application claims priority to U.S. Provisional Patent Application Ser. No. 62/916,734, entitled "SWEAT GUARD LINER," filed Oct. 17, 2019. The contents of this application are hereby incorporated by reference in their entirety.

BACKGROUND OF THE INVENTION

Headwear such as hats and similar head coverings continue to serve a purpose in everyday life and therefore continue to have demand in the marketplace. Uses for such headwear are various and include recreational, athletic, professional and the like while the comfort of such headwear varies with its use and quality of manufacturing. Prices for such headwear vary depending upon the use but are typically prohibitive for some consumers and therefore not easily replaced. Further, when using headwear in a laborious and/or warm environment, the material of the headwear often becomes stained with the user's sweat most typically in region adjacent the user's forehead. When the headwear material becomes stained, such stains are not easily removed via washing given the repetition of staining and the exposure to sunlight causing permanent staining. Permanently stained headwear could become unusable to the user, thus creating an added expense.

Given that headwear is often expensive, uncomfortable, easily stained but not easily replaced, it would be advantageous to provide a solution that reduces the cost and discomfort of owning and wearing headwear. It would be advantageous to provide a headwear insert that allows for protection from the user sweating into the headwear material while simultaneously adding a layer of comfortable padding to the interior of the headwear that may not have been manufactured with such. Further, it would be advantageous to produce a headwear insert that may be machine washed and dried in order to reduce the cost of utilizing such headwear inserts. Moreover, it would be advantageous to provide a headwear insert that is removably inserted into the given article of headwear such that the headwear insert may be utilized between a variety of articles of headwear owned by the user and further reducing the cost of use.

DETAILED DESCRIPTION OF THE INVENTION

Figure 1:
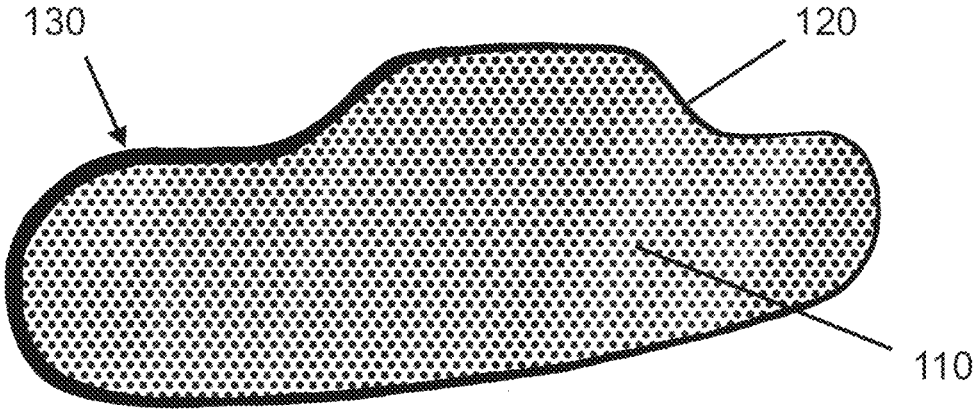
FIG. 1 is an overview of a headwear insert system in accordance with some embodiments of the present invention.

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a headwear insert system" also includes a plurality of headwear insert systems, and the like.

In some embodiments, a headwear insert system is provided comprising a headwear insert comprising a planar multilayered substrate having a first side and a second side, wherein the planar multilayered substrate comprises a substantially oblong shape with a rounded plateau protruding from a top portion of the planar multilayered substrate, wherein the planar multilayered substrate comprises a polyester mesh layer, a stabilizing layer, an absorptive layer and a neoprene layer, wherein the stabilizing layer and the absorptive layer are disposed between the polyester mesh layer and the neoprene layer, and a seam coupling the polyester mesh layer and the neoprene layer together, wherein the stabilizing layer and the absorptive layer are not coupled to the seam, the polyester mesh layer nor the neoprene layer.

In some embodiments, the planar multilayered substrate comprises one or more additional material layers selected from the group consisting of: one or more thermal regulation material layers, one or more moisture wicking material layers, one or more moisture absorption material layers, one or more comfort regulation material layers or any combination thereof.

In some embodiments, the headwear insert maintains structural integrity after at least five iterations of machine-washing and after at least five iterations of machine-drying.

In some embodiments, the headwear insert maintains substantially the same external width, length, thickness and radius of curvature dimensions, each dimension within an error range of +/−15%, but preferably within an error range of +/−5%, before the five iterations of machine-washing and the five iterations of machine-drying as after the five iterations of machine-washing and the five iterations of machine-drying.

In some embodiments, the seam removably couples the polyester mesh layer and the neoprene layer together.

In some embodiments, hook and loop fasteners are disposed along one or more portions of the seam.

In some embodiments, the seam comprises one or more openings that allow the stabilizing layer and the absorptive layer to be removably inserted between the polyester mesh layer and the neoprene layer.

In some embodiments, the seam comprises one or more openings that allow one or more additional material layers to be removably inserted between the polyester mesh layer and the neoprene layer.

In some embodiments, the one or more additional layers are selected from the group consisting of: one or more thermal regulation material layers, one or more moisture wicking material layers, one or more moisture absorption material layers, one or more comfort regulation material layers or any combination thereof.

In some embodiments, a user structurally manipulates the polyester mesh layer and the neoprene layer to removably couple the polyester mesh layer and the neoprene layer together.

In some embodiments, the planar multilayered substrate comprises a bottom portion having a shape conforming to an inner lip of a headwear article.

In some embodiments, the substantially oblong shape of the planar multilayered substrate is annular in nature.

In the preceding and following description, various techniques are described. For purposes of explanation, specific configurations and details are set forth in order to provide a thorough understanding of possible ways of implementing the techniques. However, it will also be apparent that the techniques described below may be practiced in different configurations without the specific details. Furthermore, well-known features may be omitted or simplified to avoid obscuring the techniques being described.

Exemplary embodiments of the present invention are illustrated in the accompanying figures. As shown in FIG. 1, an overview of a headwear insert system 100 is portrayed. The system 100 generally comprises an elongate planar substrate having a first side surface 110 and a second side surface 120 opposite the first side 110. In some embodiments, the first side surface 110 may be disposed directly adjacent a head of a user while the second side surface 120 may be disposed directly adjacent material of a headwear article.

The first side surface 110 and second side surface 120 (and any materials therebetween) may be stitched together along a seam 130 that follows a contour of the outer edge of the insert system 100 as shown in FIG. 1. The seam 130 may be at least partly defined by textile stitching, hook and loop fasteners and similar closure mechanisms. The contour of the outer edge of the insert system 100 may take any suitable shape but preferably resembles the contour of a forehead of the user. In some embodiments, the first side surface 110 and second side surface 120 may be removably coupled together along the seam 130 so that any materials between the first side surface 110 and second side surface 120 may be removably retained therebetween. Such removable coupling may take the form of hook and loop fasteners, zippers, snaps, adhesives and the like.

Figure 2:
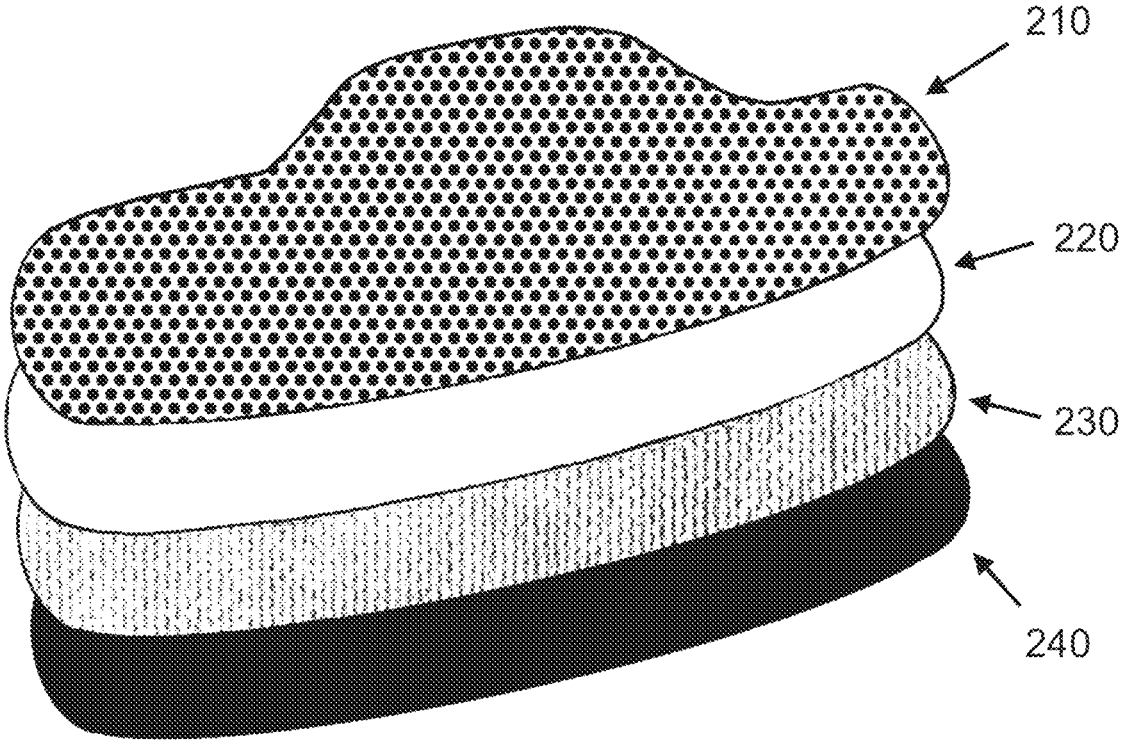
FIG. 2 is an exploded view of a headwear insert system in accordance with some embodiments of the present invention.

As shown in FIG. 2, an exploded view of a headwear insert system 200 is portrayed. The system 200 comprises a multilayered planar substrate comprising an outer layer of polyester athletic mesh 210 or like material, an inner stabilizing layer 220 or like material, an inner layer of absorptive padding 230 or like material and an outer layer of neoprene closed-cell rubber 240 or like material. One or more additional layers of material may be inserted between layer 210 and layer 240 such as, but not limited to, one or more thermal regulation material layers, one or more moisture wicking material layers, one or more moisture absorption material layers, one or more comfort regulation material layers or any combination thereof.

Each of the layers 210, 220, 230, 240 and any additional layers may be arranged in any order and may comprise any of the aforementioned materials. Preferably, layer 210 corresponds to the first side surface 110 shown in FIG. 1 and layer 240 corresponds to the second side surface 120 shown in FIG. 1. One or more of the layers 210, 220, 230, 240 and any additional layers may be removably coupled together for purposes of washing and reuse. Further, one or more of the layers 210, 220, 230, 240 and any additional material layers may be machine-washed and dried any number of times without losing structural integrity. Preferably, the layers 210, 220, 230, 240 and any additional material layers may be machine-washed and dried at least five times on any industry-standard machine-wash and dry settings without losing structural integrity. More preferably, the layers 210, 220, 230, 240 and any additional material layers may be machine-washed and dried at least fifteen times on any industry-standard machine-wash and dry settings without losing structural integrity. The ability of layers 210, 220, 230, 240 and any additional material layers to maintain structural integrity may be defined as the layers 210, 220, 230, 240 and any additional material layers maintaining substantially the same external width, length, thickness and radius of curvature dimensions within an error range of +/−15%, but preferably within an error range of +/−5%. Additionally, user may arrange each of the layers 210, 220, 230, 240 and any additional material layers according the user's desire such that layers 210, 220, 230, 240 and any additional material layers are modular in nature. Alternatively, each of layers 210, 220, 230, 240 and any additional material layers may be permanently coupled together and manufactured into a unitary member that may itself be machine-washed and dried.

Specifically, the layer of polyester athletic mesh 210 may have an aperture center-to-center distance of between 0.25-2 centimeters, but preferably 0.5-1 centimeters, with an aperture dimension of between 1-3 millimeters. Further, the mesh count of layer 210 may be between 50-300 threads crossing per square inch with a thread diameter of between 10-100 microns. Alternatively, the polyester athletic mesh layer 210 may be substituted for nylon mesh, elastane or similar materials.

The inner stabilizing layer 220 may be made from nylon, spandex, elastane or like materials and may have an aperture center-to-center distance of between 0.5-3 millimeters, but preferably 1-2.5 millimeters, with an aperture dimension of between 0.25-2 millimeters, but preferably 0.75-1.5 millimeters. Additionally, the mesh count of layer 220 may be between 50-300 threads crossing per square inch with a thread diameter of between 0.25-2 millimeters, but preferably between 0.75-1.5 millimeters. Alternatively, the inner stabilizing layer 220 may be supplemented with cotton, bamboo or similar like materials.

The inner layer of absorptive padding 230 may be made from any suitable materials including, but not limited to, short-staple cotton, long-staple cotton, extra-long-staple cotton, Egyptian cotton, Pima cotton, Supima cotton, rayon, bamboo or combinations thereof. Further, the absorptive padding layer 230 may have a thread count between 50-300 threads crossing per square inch and a thickness of between 0.5-3 millimeters, but preferably between 1-2.5 millimeters.

The outer layer of neoprene closed-cell rubber 240 may have a thickness of between 1-4 millimeters, but preferably between 2-3 millimeters. Alternative materials to neoprene closed-cell rubber may include, but are not limited to, synthetic rubber, foam rubber, sponge rubber, silicone rubber, natural rubber, other elastomers and any combination thereof. The entirety of the insert system 200 may have length dimensions of between 5-15 inches, but preferably 9-12 inches, and width dimensions of between 2-6 inches, but preferably 3-4 inches.

Such additional materials which may be placed between layer 210 and layer 240 may include one or more thermal regulation material layers including, but are not limited to, hydroxyethyl cellulose, sodium polyacrylate, silica gel and various phase change materials including hydrocarbon paraffins and salt hydrates. Other additional materials may include one or more moisture-wicking material layers including, but not limited to, polyester, polypropylene, merino wool, wool, nylon, micromodal, bamboo and similar materials. Further additional materials may include one or more moisture absorption material layers including, but not limited to, cotton, anhydrous calcium chloride, soda lime, silica gel, activated carbon, sodium polyacrylate and similar materials. Further additional materials may include one or more comfort regulation material layers including, but not limited to, gel, moleskin, felt, wool, foam, Terry cloth, cotton and similar materials.

Each of such additional material layers which may be placed between layer 210 and layer 240 may be removable from the insert system 200 and separable from each other layer within the insert system 200 in order to facilitate machine washing and machine drying of the given one or more layers. After machine washing and machine drying, each of the one or the more layers may be reinserted into the insert system 200 and disposed adjacent the other of the one or more layers. Further, if one or more layers of the insert system 200 require replacement, the separability of the layers will allow for such layers to be replaced and further allows the user to add or remove one or more layers within the insert system 200 based upon the user's particular needs and desires.

Specifically, circumstances may motivate the user to add, remove and/or replace one or more layers of the insert system 200. Such circumstances may include the type of headwear being utilized by the user. For example, an article of athletic headwear may have a drastically different contour against the user's head than an article of construction headwear. Therefore, a user may desire to add additional layers of comfort padding to the insert system 200 when used in conjunction with an article of construction headwear.

Further, a user of the insert system 200 may require different material layers based upon the external environment in which the user will be wearing the article of headwear. For example, in warmer humid environments, additional material layers of moisture absorption and/or wicking may be desired as opposed to colder arid environments. The ability to selectively remove and add such additional material layers allows the user to change the content of the insert system 200 according to the change in weather.

Similarly, the type of activity being performed by the user may determine the quantity and type of material layers to be utilized in the insert system 200. For example, a user utilizing an article of headwear for hard manual labor may desire additional layers of moisture absorption and/or wicking in the insert system 200 as opposed to a user utilizing an article of headwear for leisure purposes. Further, the degree to which an article of headwear fits the user may determine the quantity and type of material layers to be utilized in the insert system 200. For example, if an article of headwear provides an ill-fit when worn by the user, then the user may utilize one or more additional layers of comfort padding to compensate the ill-fit of the headwear article thus producing a better fit. Further, one or more material layers may be removed from the insert system 200 to similarly create a better fit between the headwear article and user.

While the outer contour of insert system is shown in FIG. 1 as being defined by the seam 130, it is to be understood that any suitable outer contour may be utilized to accommodate the given user and article of headwear. Specifically, FIGS. 1 & 2 show the insert system as being generally oblong in shape with a rounded plateau protruding from a top portion thereof. This rounded plateau protrusion is designed to accommodate the vertically elongate shape of most human foreheads which therefore protects the entirety of the associated headwear article material.

Alternatively, the insert system may be annular in shape and may be disposed adjacent the entirety of the interior of the article of headwear upon insertion, thus providing protection from user sweat along all portions of headwear article material adjacent the user. Further, in this embodiment, the insert system may optionally not include the rounded plateau protrusion but rather may be uniformly annular in shape.

Figure 3A:
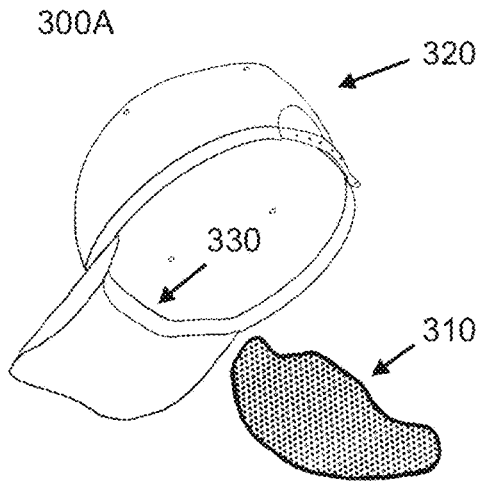
FIG. 3A is an overview of a headwear insert system separate from a headwear article in accordance with some embodiments of the present invention.

As shown in FIG. 3A, an overview of a headwear insert system 300A comprising a headwear insert 310 separate from a headwear article 320 is portrayed. The headwear insert 310 may be handled by a user to be placed within the headwear article 320 at a frontal position located within the inner lip 330 thereof. The user may simply fold the inner lip 330 down and place the insert 310 at the frontal position before folding the inner lip 330 back up to secure the insert 310 in place.

Figure 3B:
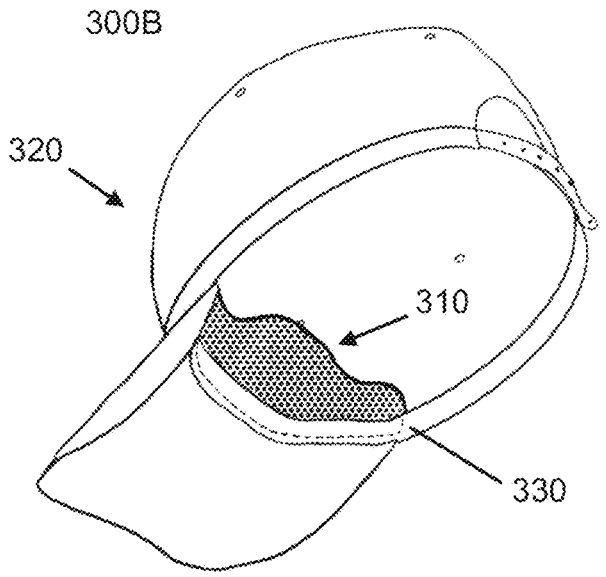
FIG. 3B is an overview of a headwear insert system secured within a headwear article in accordance with some embodiments of the present invention.

As shown in FIG. 3B, an overview of a headwear insert system 300B comprising a headwear insert 310 secured within a headwear article is portrayed. The headwear insert 310 is secured behind the inner lip 330 of the headwear article 320. While the inner lip 330 by itself may not fully secure the insert 310, it provides enough support to allow the user to place the headwear article 320 upon their head and thus securing the insert 310 in place against the user's forehead.

Figure 4A:
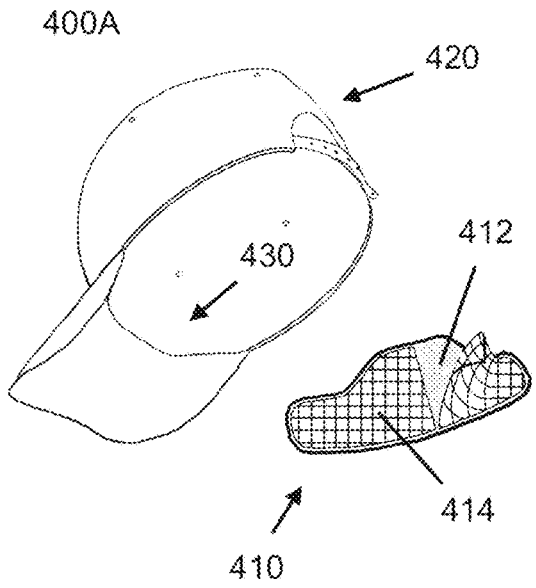
FIG. 4A is an overview of a headwear insert system with adhesive backing separate from a headwear article in accordance with some embodiments of the present invention.

As shown in FIG. 4A, an overview of a headwear insert system 400A comprising a headwear insert 410 separate from a headwear article 420 is portrayed. In this embodiment, the headwear article 420 does not comprise the inner lip 330 of FIGS. 3A & 3B. The headwear insert 410 may comprise an adhesive backing 412 for attachment to a desired position 430 along the interior the headwear article 420. The adhesive backing 412 may be protected by a disposable liner 414 comprising one or more pieces prior to the user adhering the headwear insert 410 to the desired position 430. User may manually remove the one or more pieces of the protective liner 414 in order to expose the adhesive backing 412 to the desired position 430 of the headwear article 420.

Preferably, the adhesive backing 412 is a thin layer of adhesive material that may be made from one or more of acrylates, methacrylates, epoxy diacrylates, vinyl resins and similar materials. With reference to FIG. 1, the adhesive backing 412 may be disposed over the second side surface 120 of the headwear insert system facing the material of the headwear insert. With reference to FIG. 2, the adhesive backing 412 may be disposed over the outer layer of neoprene closed-cell rubber 240 or like material. The disposable liner 414 may be made from wax-coated paper or any suitable plastic material. Alternatively, the adhesive of the backing 412 may be replaced with any suitable coupling means including, but not limited to, hook and loop fasteners, magnets, static adhesion or any combinations thereof.

Figure 4B:
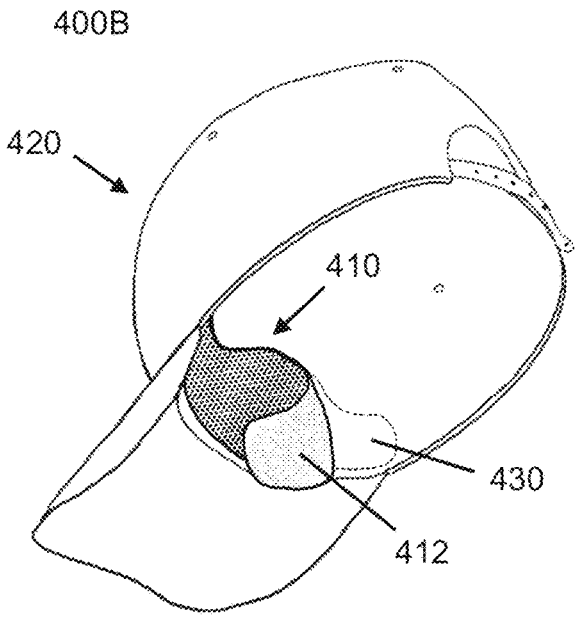
FIG. 4B is an overview of a headwear insert system with adhesive backing secured within a headwear article in accordance with some embodiments of the present invention.

As shown in FIG. 4B, an overview of a headwear insert system 400B comprising a headwear insert 410 secured within a headwear article 420 is portrayed. As in FIG. 4A, the headwear article 420 of FIG. 4B does not comprise the inner lip 330 of FIGS. 3A & 3B. After exposing the adhesive backing 412 by removing the disposable liner 414, the user places the adhesive backing 412 upon a desired position 430 along the interior of the headwear article 420 with the adhesive backing 412 facing the material of the headwear article 420.

While in FIGS. 4A & 4B the desired position 430 is shown to be a frontal position of the headwear article 420, it is to be understood that any position along the interior of the headwear article may be utilized as the desired position 430 based upon the need of the user and the given headwear article 420. Further, while in FIGS. 3A, 3B, 4A & 4C the headwear article 420 is shown to be an athletic cap, it is to be understood that any suitable type of headwear article 420 may be utilized including, but not limited to, athletic caps, cowboy hats, fashion headdress, construction hats, automotive helmets, sports helmets, winter headwear and the like.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A headwear insert system, comprising:

a headwear insert comprising a planar multilayered substrate having a first side and a second side, wherein the planar multilayered substrate comprises a substantially oblong shape with a rounded plateau protruding from a top portion of the planar multilayered substrate, wherein the planar multilayered substrate comprises a polyester mesh layer, a stabilizing layer, an absorptive layer and a neoprene layer, wherein the stabilizing layer and the absorptive layer are disposed between the polyester mesh layer and the neoprene layer; and a seam coupling the polyester mesh layer and the neoprene layer together, wherein the stabilizing layer and the absorptive layer are not coupled to the seam, the polyester mesh layer nor the neoprene layer.

2. The headwear insert system of claim 1, wherein the planar multilayered substrate comprises one or more additional material layers selected from the group consisting of: one or more thermal regulation material layers, one or more moisture wicking material layers, one or more moisture absorption material layers, one or more comfort regulation material layers or any combination thereof.

3. The headwear insert system of claim 1, wherein the headwear insert maintains structural integrity after machine-washing.

4. The headwear insert system of claim 1, wherein the headwear insert maintains structural integrity after machine-drying.

5. The headwear insert system of claim 1, wherein the seam removably couples the polyester mesh layer and the neoprene layer together.

6. The headwear insert system of claim 5, wherein hook and loop fasteners are disposed along one or more portions of the seam.

7. The headwear insert system of claim 5, wherein the seam comprises one or more openings that allow the stabilizing layer and the absorptive layer to be removably inserted between the polyester mesh layer and the neoprene layer.

8. The headwear insert system of claim 5, wherein the seam comprises one or more openings that allow one or more additional material layers to be removably inserted between the polyester mesh layer and the neoprene layer.

9. The headwear insert system of claim 8, wherein the one or more additional material layers are selected from the group consisting of: one or more thermal regulation material layers, one or more moisture wicking material layers, one or more moisture absorption material layers, one or more comfort regulation material layers or any combination thereof.

10. The headwear insert system of claim 5, wherein a user structurally manipulates the polyester mesh layer and the neoprene layer to removably couple the polyester mesh layer and the neoprene layer together.

11. The headwear insert system of claim 1, wherein the planar multilayered substrate comprises a bottom portion having a shape conforming to an inner lip of a headwear article.

12. The headwear insert system of claim 11, wherein the substantially oblong shape of the planar multilayered substrate is annular in nature.

13. A headwear insert system, comprising:

a headwear insert comprising a planar multilayered substrate having a first side and a second side, wherein the planar multilayered substrate comprises a substantially oblong shape with a rounded plateau protruding from a top portion of the planar multilayered substrate, wherein the planar multilayered substrate comprises a polyester mesh layer, a stabilizing layer, an absorptive layer and a neoprene layer, wherein the stabilizing layer and the absorptive layer are disposed between the polyester mesh layer and the neoprene layer, wherein the planar multilayered substrate comprises a bottom portion having a shape conforming to an inner lip of a headwear article; and a seam coupling the polyester mesh layer and the neoprene layer together, wherein the stabilizing layer and the absorptive layer are not coupled to the seam, the polyester mesh layer nor the neoprene layer.

14. The headwear insert system of claim 13, wherein the headwear insert maintains structural integrity after machine-washing and machine-drying.

15. The headwear insert system of claim 14, wherein the headwear insert maintains structural integrity after at least five iterations of machine-washing and after at least five iterations of machine-drying.

16. The headwear insert system of claim 15, wherein the headwear insert maintains substantially the same external width, length, thickness and radius of curvature dimensions, each dimension within an error range of +/−15%, before the five iterations of machine-washing and the five iterations of machine-drying as after the five iterations of machine-washing and the five iterations of machine-drying.

17. The headwear insert system of claim 16, wherein the headwear insert maintains substantially the same external width, length, thickness and radius of curvature dimensions, each dimension within an error range of +/−5%, before the five iterations of machine-washing and the five iterations of machine-drying as after the five iterations of machine-washing and the five iterations of machine-drying.

18. A headwear insert system, comprising:

a headwear insert comprising a planar multilayered substrate having a first side and a second side, wherein the planar multilayered substrate comprises a substantially oblong shape with a rounded plateau protruding from a top portion of the planar multilayered substrate, wherein the planar multilayered substrate comprises a polyester mesh layer, a stabilizing layer, an absorptive layer and a neoprene layer, wherein the stabilizing layer and the absorptive layer are disposed between the polyester mesh layer and the neoprene layer, wherein the planar multilayered substrate comprises a bottom portion having a shape conforming to an inner lip of a headwear article, wherein the headwear insert maintains structural integrity after at least five iterations of machine-washing, wherein the headwear insert maintains structural integrity after at least five iterations of machine-drying; and a seam coupling the polyester mesh layer and the neoprene layer together, wherein the stabilizing layer and the absorptive layer are not coupled to the seam.

19. The headwear insert system of claim 18, wherein the seam comprises one or more openings that allow one or more additional material layers to be removably inserted between the polyester mesh layer and the neoprene layer.

20. The headwear insert system of claim 19, wherein the one or more additional material layers are selected from the group consisting of: one or more thermal regulation material layers, one or more moisture wicking material layers, one or more moisture absorption material layers, one or more comfort regulation material layers or any combination thereof.

* * * * *